US009032685B2

(12) United States Patent
Martensson et al.

(10) Patent No.: US 9,032,685 B2
(45) **Date of Patent: *May 19, 2015**

(54) FLOORING PANEL OR WALL PANEL AND USE THEREOF

(75) Inventors: Goran Martensson, Klagstorp (SE); Magnus Kulik, Vellinge (SE)

(73) Assignee: PERGO (EUROPE) AB, Trelleborg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 13/463,329

(22) Filed: May 3, 2012

(65) Prior Publication Data

US 2012/0216472 A1 Aug. 30, 2012

Related U.S. Application Data

(60) Continuation of application No. 11/483,636, filed on Jul. 11, 2006, now Pat. No. 8,402,709, which is a division of application No. 10/642,139, filed on Aug. 18, 2003, now Pat. No. 7,131,242, which is a division (Continued)

(30) Foreign Application Priority Data

Mar. 7, 1995 (SE) ..... 9500810

(51) Int. Cl.
*E04B 2/00* (2006.01)
*E04B 1/61* (2006.01)
(Continued)

(52) U.S. Cl.
CPC ..... *E04B 1/6129* (2013.01); *E04F 13/0878* (2013.01); *E04F 15/02* (2013.01);

(Continued)

(58) Field of Classification Search
CPC ..... E04F 15/02038; E04F 15/02; E04F 2201/0153; E04F 2201/0115; E04F 2201/0146; E04F 15/107; E04F 15/022; E04F 15/16; E04F 13/0894; E04F 13/0889; E04F 2201/0161; E04F 2201/0176; E04F 2201/023; E04F 2201/03; E04F 2201/0535; E04F 2201/041; E04F 2201/025
USPC ..... 52/282.1, 591.1, 592.2, 582.1, 586.1, 52/591.3, 591.4, 592.1; 403/381, 364
See application file for complete search history.

(56) References Cited

U.S. PATENT DOCUMENTS 208,036 A 9/1878 Robley
213,740 A 4/1879 Conner
(Continued)

FOREIGN PATENT DOCUMENTS

AU 199732569 12/1999
AU 200020703 6/2000
(Continued)

OTHER PUBLICATIONS

Appeals from the United States District Court for the Eastern District of Wisconsin; Consolidated case No. 02-.
(Continued)

*Primary Examiner* — Chi Q Nguyen
(74) *Attorney, Agent, or Firm* — Jenkins, Wilson, Taylor & Hunt, P.A.

(57) ABSTRACT

A building panel, such as a flooring panel or wall panel and a method of assembling the same into a floor, wall cladding, etc. The panel is provided with a locking means in the form of groove (6) and tongue (7) forming a tongue/groove joint for assembling of the panels. In a preferred embodiment, the groove (6) and the tongue (7) are made of water resistant material and fanned with a snap-together joint.

18 Claims, 4 Drawing Sheets

Related U.S. Application Data of application No. 10/195,408, filed on Jul. 16, 2002, now Pat. No. 6,606,834, which is a continuation of application No. 09/705,916, filed on Nov. 6, 2000, now Pat. No. 6,421,970, which is a continuation-in-part of application No. 09/637,114, filed on Aug. 11, 2000, now Pat. No. 6,418,683, which is a continuation-in-part of application No. 08/894,966, filed as application No. PCT/SE96/00256 on Feb. 29, 1996, now Pat. No. 6,101,778.

(51) Int. Cl.
*E04F 13/08* (2006.01)
*E04F 15/02* (2006.01)
*E04F 15/10* (2006.01)

(52) U.S. Cl.
CPC ..... *E04F 15/10* (2013.01); *E04F 2201/0107* (2013.01); *E04F 2201/0115* (2013.01); *E04F 2201/0123* (2013.01); *E04F 2201/023* (2013.01); *E04F 2201/049* (2013.01); *E04F 2201/07* (2013.01)

(56) References Cited

U.S. PATENT DOCUMENTS 308,313 A 11/1884 Gerike
342,529 A 5/1886 McRae
662,458 A 11/1900 Nagel
714,987 A 12/1902 Wolfe
752,694 A 2/1904 Lund
753,791 A 3/1904 Fulghum
769,355 A 9/1904 Platow
832,003 A 9/1906 Torrence
847,272 A 3/1907 Ayers
877,639 A 1/1908 Galbraith
898,381 A 9/1908 Mattison
1,000,859 A 8/1911 Vaughan
1,002,102 A 8/1911 Weedon
1,016,383 A 2/1912 Wellman
1,097,986 A 5/1914 Moritz
1,124,226 A 1/1915 Houston
1,124,228 A 1/1915 Houston
1,137,197 A 4/1915 Ellis
1,140,958 A 5/1915 Cowan
1,266,253 A 5/1918 Hakason
1,319,286 A 10/1919 Johnson et al.
1,357,713 A 11/1920 Lane
1,407,679 A 2/1922 Ruchraugg
1,454,250 A 5/1923 Parsons
1,468,288 A 9/1923 Fen
1,510,924 A 10/1924 Daniels et al.
1,540,128 A 6/1925 Houston
1,575,821 A 3/1926 Daniels
1,576,527 A 3/1926 McBride
1,576,821 A 3/1926 Daniels
1,602,256 A 10/1926 Sellin
1,602,267 A 10/1926 Karwisde
1,615,096 A 1/1927 Myers
1,622,103 A 3/1927 Fulton
1,622,104 A 3/1927 Fulton
1,637,634 A 8/1927 Carter
1,644,710 A 10/1927 Crooks
1,657,159 A 1/1928 Greenebaum
1,660,480 A 2/1928 Daniels
1,706,924 A 3/1929 Kane
1,714,738 A 5/1929 Smith
1,718,702 A 6/1929 Pfiester
1,734,826 A 11/1929 Pick
1,736,539 A 11/1929 Lachman
1,764,331 A 6/1930 Moratz
1,772,417 A 8/1930 Ellinwood
1,776,188 A 9/1930 Langbaum
1,823,039 A 9/1930 Gruner
1,778,069 A 10/1930 Fetz
1,787,027 A 12/1930 Wasleff
1,801,093 A 4/1931 Larkins
1,843,024 A 1/1932 Werner
1,854,396 A 4/1932 Davis
1,859,667 A 5/1932 Gruner
1,898,364 A 2/1933 Gynn
1,906,411 A 5/1933 Potvin
1,913,342 A 6/1933 Schaffert
1,929,871 A 10/1933 Jones
1,940,377 A 12/1933 Storm
1,953,306 A 4/1934 Moratz
1,966,020 A 7/1934 Rowley
1,978,075 A 10/1934 Butterworth
1,986,739 A 1/1935 Mitte
1,988,201 A 1/1935 Hall
1,991,701 A 2/1935 Roman
2,004,193 A 6/1935 Cherry
2,015,813 A 10/1935 Nielsen
2,027,292 A 1/1936 Rockwell
2,044,216 A 6/1936 Klages
2,045,067 A 6/1936 Bruce
2,049,571 A 8/1936 Schuck
2,100,238 A 11/1937 Burgess
2,126,956 A 8/1938 Gilbert
2,138,085 A 11/1938 Birtles
2,141,708 A 12/1938 Elmendorf
2,142,305 A 1/1939 Davis
2,194,086 A 3/1940 Horn
2,199,938 A 5/1940 Kloote
2,222,137 A 11/1940 Bruce
2,238,169 A 4/1941 Heyn et al.
2,245,497 A 6/1941 Ptchen
2,253,943 A 8/1941 Rice
2,266,464 A 12/1941 Kraft
2,276,071 A 3/1942 Scull
2,280,071 A 4/1942 Hamilton
2,282,559 A 5/1942 Byers
2,324,628 A 7/1943 Kahr
2,363,429 A 11/1944 Lowry
2,398,632 A 4/1946 Frost et al.
2,405,602 A 8/1946 Nugent
2,430,200 A 11/1947 Wilson
2,487,571 A 11/1949 Maxwell
2,491,498 A 12/1949 Kahr
2,644,552 A 7/1953 MacDonanld
2,717,420 A 9/1955 Georges
2,729,584 A 1/1956 Foster
2,740,167 A 4/1956 Rowley
2,780,253 A 2/1957 Joa
2,808,624 A 10/1957 Sullivan
2,823,433 A 2/1958 Kendall
2,839,790 A 6/1958 Collings
2,857,302 A 10/1958 Burton et al.
2,863,185 A 12/1958 Reidi
2,865,058 A 12/1958 Andersson et al.
2,878,530 A 3/1959 Hilding
2,894,292 A 7/1959 Gramelspacher
2,926,401 A 3/1960 Place
2,831,223 A 9/1960 DeShazor
2,952,341 A 9/1960 Weiler
2,996,751 A 8/1961 Roby
3,045,294 A 7/1962 Livezey, Jr.
3,090,082 A 5/1963 Bauman
3,100,556 A 8/1963 Ridder
3,125,138 A 3/1964 Bolenbach
3,128,851 A 4/1964 Deridder et al.
3,141,392 A 7/1964 Schneider
3,148,482 A 9/1964 Neale
3,162,906 A 12/1964 Dudley
3,182,769 A 5/1965 de Ridder
3,199,258 A 8/1965 Jentoft et al.
3,203,149 A 8/1965 Soddy
3,204,380 A 9/1965 Wilson
3,253,377 A 5/1966 Schakel
3,257,225 A 6/1966 Marotta
3,267,630 A 8/1966 Omholt
3,282,010 A 11/1966 King, Jr.
3,286,425 A 11/1966 Brown

(56) References Cited

U.S. PATENT DOCUMENTS

| | | | |
|---|---|---|---|
| 3,296,056 | A | 1/1967 | Bechtold |
| 3,301,147 | A | 1/1967 | Clayton et al. |
| 3,310,919 | A | 3/1967 | Bue |
| 3,331,171 | A | 7/1967 | Hallock |
| 3,339,329 | A | 9/1967 | Berg |
| 3,347,048 | A | 10/1967 | Brown et al. |
| 3,362,127 | A | 1/1968 | McGowan |
| 3,363,381 | A | 1/1968 | Forrest |
| 3,363,382 | A | 1/1968 | Forrest |
| 3,363,383 | A | 1/1968 | La Barge |
| 3,373,071 | A | 3/1968 | Fuerst |
| 3,377,931 | A | 4/1968 | Hilton |
| 3,387,422 | A | 6/1968 | Wanzer |
| 3,397,496 | A | 8/1968 | Sohns |
| 3,444,660 | A | 5/1969 | Feichter |
| 3,449,879 | A | 6/1969 | Bloom |
| 3,460,304 | A | 8/1969 | Braeuninger et al. |
| 3,473,278 | A | 10/1969 | Gossen |
| 3,474,584 | A | 10/1969 | Lynch |
| 3,479,784 | A | 11/1969 | Massagli |
| 3,481,810 | A | 12/1969 | Waite |
| 3,488,828 | A | 1/1970 | Gallagher |
| 3,496,119 | A | 2/1970 | Fitzgerald |
| 3,508,369 | A | 4/1970 | Tennison |
| 3,526,420 | A | 9/1970 | Brancaleone |
| 3,535,844 | A | 10/1970 | Glaros |
| 3,538,665 | A | 11/1970 | Gohner |
| 3,538,819 | A | 11/1970 | Gould et al. |
| 3,553,919 | A | 1/1971 | Omholt |
| 3,555,762 | A | 1/1971 | Costanzo, Jr. |
| 3,570,205 | A | 3/1971 | Payne |
| 3,572,224 | A | 3/1971 | Perry |
| 3,579,941 | A | 5/1971 | Tibbals |
| 3,619,964 | A | 11/1971 | Passaro et al. |
| 3,627,362 | A | 12/1971 | Brenneman |
| 3,657,852 | A | 4/1972 | Worthington et al. |
| 3,665,666 | A | 5/1972 | Delcroix |
| 3,671,369 | A | 6/1972 | Kvalheim et al. |
| 3,687,773 | A | 8/1972 | Wangborg |
| 3,694,983 | A | 10/1972 | Couquet |
| 3,696,575 | A | 10/1972 | Armstrong |
| 3,707,061 | A | 12/1972 | Collette et al. |
| 3,714,747 | A | 2/1973 | Curran |
| 3,720,027 | A | 3/1973 | Christensen |
| 3,731,445 | A | 5/1973 | Hoffmann et al. |
| 3,745,726 | A | 7/1973 | Thom |
| 3,758,650 | A | 9/1973 | Hurst |
| 3,759,007 | A | 9/1973 | Thiele |
| 3,760,544 | A | 9/1973 | Hawes et al. |
| 3,768,846 | A | 10/1973 | Hensley et al. |
| 3,778,958 | A | 12/1973 | Fowler |
| 3,798,111 | A | 3/1974 | Lana et al. |
| 3,807,113 | A | 4/1974 | Turner |
| 3,808,030 | A | 4/1974 | Bell |
| 3,810,707 | A | 5/1974 | Tungseth et al. |
| 3,849,240 | A | 11/1974 | Mikulak |
| 3,859,000 | A | 1/1975 | Webster |
| 3,884,328 | A | 5/1975 | Williams |
| 3,902,293 | A | 9/1975 | Witt et al. |
| 3,908,053 | A | 9/1975 | Hettich |
| 3,908,062 | A | 9/1975 | Roberts |
| 3,921,312 | A | 11/1975 | Fuller |
| 3,936,551 | A | 2/1976 | Elmendorf et al. |
| 3,953,661 | A | 4/1976 | Gulley |
| 3,988,187 | A | 10/1976 | Witte et al. |
| 4,059,933 | A | 11/1977 | Funk et al. |
| 4,060,437 | A | 11/1977 | Strout |
| 4,065,902 | A | 1/1978 | Lindal |
| 4,067,155 | A | 1/1978 | Ruff et al. |
| 4,074,496 | A | 2/1978 | Fischer |
| 4,090,338 | A | 5/1978 | Bourgade |
| 4,099,358 | A | 7/1978 | Compaan |
| 4,144,689 | A | 3/1979 | Bains |
| 4,150,517 | A | 4/1979 | Warner |
| 4,158,335 | A | 6/1979 | Belcastro |
| 4,164,832 | A | 8/1979 | Van Zandt |
| 4,169,688 | A | 10/1979 | Toshio |
| 4,186,539 | A | 2/1980 | Harmon et al. |
| 4,198,455 | A | 4/1980 | Spiro et al. |
| 4,242,390 | A | 12/1980 | Nemeth |
| 4,247,390 | A | 1/1981 | Knoll |
| 4,292,774 | A | 10/1981 | Mairle |
| 4,299,070 | A | 11/1981 | Oltmanns et al. |
| 4,316,351 | A | 2/1982 | Ting |
| 4,376,593 | A | 3/1983 | Schaefer |
| 4,390,580 | A | 6/1983 | Donovan et al. |
| 4,426,820 | A | 1/1984 | Terbrack et al. |
| 4,449,346 | A | 5/1984 | Tremblay |
| 4,455,803 | A | 6/1984 | Kornberger |
| 4,461,131 | A | 7/1984 | Pressell |
| 4,471,012 | A | 9/1984 | Maxwell |
| 4,501,102 | A | 2/1985 | Knowles |
| 4,504,347 | A | 3/1985 | Munk et al. |
| 4,505,887 | A | 3/1985 | Miyata et al. |
| 4,520,062 | A | 5/1985 | Ungar et al. |
| 4,561,233 | A | 12/1985 | Harter et al. |
| 4,571,910 | A | 2/1986 | Cosentino |
| 4,594,347 | A | 6/1986 | Ishikawa et al. |
| 4,599,124 | A | 7/1986 | Kelly et al. |
| 4,599,841 | A | 7/1986 | Haid |
| 4,599,842 | A | 7/1986 | Counihan |
| 4,612,745 | A | 9/1986 | Hovde |
| 4,621,471 | A | 11/1986 | Kuhr et al. |
| 4,641,469 | A | 2/1987 | Wood |
| 4,643,237 | A | 2/1987 | Rosa |
| 4,653,138 | A | 3/1987 | Carder |
| 4,653,242 | A | 3/1987 | Ezard |
| 4,672,728 | A | 6/1987 | Nimberger |
| 4,683,631 | A | 8/1987 | Dobbertin |
| 4,703,597 | A | 11/1987 | Eggemar |
| 4,715,162 | A | 12/1987 | Brightwell |
| 4,733,510 | A | 3/1988 | Werner |
| 4,736,563 | A | 4/1988 | Bilhorn |
| 4,738,071 | A | 4/1988 | Ezard |
| 4,747,197 | A | 5/1988 | Charron |
| 4,757,657 | A | 7/1988 | Mitchell |
| 4,757,658 | A | 7/1988 | Kaempen |
| 4,769,963 | A | 9/1988 | Meyerson |
| 4,796,402 | A | 1/1989 | Pajala |
| 4,806,435 | A | 2/1989 | Athey |
| 4,819,932 | A | 4/1989 | Trotter, Jr. et al. |
| 4,831,806 | A | 5/1989 | Niese et al. |
| 4,844,972 | A | 7/1989 | Tedeschi et al. |
| 4,845,907 | A | 7/1989 | Meek |
| 4,893,449 | A | 1/1990 | Kemper |
| 4,894,272 | A | 1/1990 | Alsley |
| 4,905,442 | A | 3/1990 | Daniels |
| 4,910,280 | A | 3/1990 | Robbins, III |
| 4,920,626 | A | 5/1990 | Nimberger |
| 4,940,503 | A | 7/1990 | Lindgren et al. |
| 4,952,775 | A | 8/1990 | Yokoyama et al. |
| 4,953,335 | A | 9/1990 | Kawaguchi et al. |
| 4,988,131 | A | 1/1991 | Wilson et al. |
| 4,998,395 | A | 3/1991 | Bezner |
| 4,998,396 | A | 3/1991 | Palmersten |
| 5,003,016 | A | 3/1991 | Boeder |
| 5,029,425 | A | 7/1991 | Bogataj |
| 5,034,272 | A | 7/1991 | Lindgren et al. |
| 5,050,362 | A | 9/1991 | Tal et al. |
| 5,070,662 | A | 12/1991 | Niese |
| 5,074,089 | A | 12/1991 | Kemmer et al. |
| 5,086,599 | A | 2/1992 | Meyerson |
| 5,092,095 | A | 3/1992 | Zadok et al. |
| 5,113,632 | A | 5/1992 | Hanson |
| 5,117,603 | A | 6/1992 | Weintraub |
| 5,138,812 | A | 8/1992 | Palmersten |
| 5,148,850 | A | 9/1992 | Urbanick |
| 5,155,952 | A | 10/1992 | Herwegh et al. |
| 5,165,816 | A | 11/1992 | Parasin |
| 5,179,811 | A | 1/1993 | Walker et al. |
| 5,179,812 | A | 1/1993 | Hill |
| 5,216,861 | A | 6/1993 | Meyerson |
| 5,244,303 | A | 9/1993 | Hair |
| 5,247,773 | A | 9/1993 | Weir |

(56) References Cited

U.S. PATENT DOCUMENTS 5,253,464 A 10/1993 Nilsen
5,259,162 A 11/1993 Nicholas
5,271,564 A 12/1993 Smith
5,274,979 A 1/1994 Tsai
5,292,155 A 3/1994 Bell et al.
5,295,341 A 3/1994 Kajiwara
5,325,649 A 7/1994 Kajiwara
5,343,665 A 9/1994 Palmersten
5,344,700 A 9/1994 McGath et al.
5,348,778 A 9/1994 Knipp et al.
5,349,796 A 9/1994 Meyerson
5,359,817 A 11/1994 Fulton
5,365,713 A 11/1994 Nicholas et al.
5,390,457 A 2/1995 Sjolander
5,424,118 A 6/1995 McLaughlin
5,433,048 A 7/1995 Strasser
5,433,806 A 7/1995 Pasquali et al.
5,474,831 A 12/1995 Nystrom
5,497,589 A 3/1996 Porter
5,502,939 A 4/1996 Zadok et al.
5,527,128 A 6/1996 Rope et al.
5,540,025 A 7/1996 Takehara et al.
D373,203 S 8/1996 Kornfalt
5,567,497 A 10/1996 Zegler et al.
5,570,554 A 11/1996 Searer
5,581,967 A 12/1996 Glatz
5,597,024 A 1/1997 Bolyard et al.
5,618,602 A 4/1997 Nelson
5,618,612 A 4/1997 Gstrein
5,623,799 A 4/1997 Kowalski
5,630,304 A 5/1997 Austin
5,657,598 A 8/1997 Wilbs et al.
5,671,575 A 9/1997 Wu
5,685,117 A 11/1997 Nicholson
5,688,569 A 11/1997 Gilmore et al.
5,692,354 A 12/1997 Searer
5,695,875 A 12/1997 Larsson et al.
5,706,621 A 1/1998 Pervan
5,706,623 A 1/1998 Brown
5,719,239 A 2/1998 Mirous et al.
5,735,092 A 4/1998 Clayton et al.
5,736,227 A 4/1998 Sweet et al.
5,765,808 A 6/1998 Butschbacher et al.
5,791,114 A 8/1998 Mandel
5,797,237 A 8/1998 Finkell, Jr.
5,823,240 A 10/1998 Bolyard et al.
5,827,592 A 10/1998 Van Gulik et al.
5,860,267 A 1/1999 Pervan
5,888,017 A 3/1999 Corrie
5,894,701 A 4/1999 Delorme
5,904,019 A 5/1999 Kooij et al.
5,907,934 A 6/1999 Austin
5,930,947 A 8/1999 Eckhoff
5,931,447 A 8/1999 Butschbacher et al.
5,935,668 A 8/1999 Smith
5,941,047 A 8/1999 Johansson
5,943,239 A 8/1999 Shamblin et al.
5,945,181 A 8/1999 Fisher
5,950,389 A 9/1999 Porter
5,968,625 A 10/1999 Hudson
5,971,655 A 10/1999 Shirakawa
5,987,839 A 11/1999 Hamar et al.
5,987,845 A 11/1999 Laronde
5,996,301 A 12/1999 Conterno
6,006,486 A 12/1999 Moriau et al.
6,012,263 A 1/2000 Church et al.
6,021,615 A 2/2000 Brown
6,021,646 A 2/2000 Burley
6,023,907 A 2/2000 Pervan
6,029,416 A 2/2000 Andersson
6,079,182 A 6/2000 Ellenberger
6,094,882 A 8/2000 Pervan
6,101,778 A 8/2000 Maartensson
6,119,423 A 9/2000 Costantino
6,134,854 A 10/2000 Stanchfield
6,141,920 A 11/2000 Kemper
6,143,119 A 11/2000 Seidner
6,148,884 A 11/2000 Bolyard et al.
6,158,915 A 12/2000 Kise
6,182,410 B1 2/2001 Pervan
6,182,413 B1 2/2001 Magnusson
6,189,283 B1 2/2001 Bentley
6,205,639 B1 3/2001 Pervan
6,209,278 B1 4/2001 Tychsen
6,216,403 B1 4/2001 Belbeoc'h
6,216,409 B1 4/2001 Roy et al.
6,219,982 B1 4/2001 Eyring
6,230,385 B1 5/2001 Nelson
6,233,899 B1 5/2001 Mellert et al.
6,247,285 B1 6/2001 Moebus
6,253,514 B1 7/2001 Jobe et al.
6,314,701 B1 11/2001 Meyerson
6,324,803 B1 12/2001 Pervan
6,324,809 B1 12/2001 Nelson
6,332,733 B1 12/2001 Hamberger et al.
6,345,480 B1 2/2002 Kemper
6,345,481 B1 2/2002 Nelson
6,363,677 B1 4/2002 Chen et al.
6,365,258 B1 4/2002 Alm
6,385,936 B1 5/2002 Schneider
6,397,547 B1 6/2002 Martensson
6,418,683 B1 7/2002 Martensson et al.
6,421,970 B1 7/2002 Martensson et al.
6,423,257 B1 7/2002 Stobart
6,438,919 B1 8/2002 Knauseder
6,446,405 B1 9/2002 Pervan
6,505,452 B1 1/2003 Hannig et al.
6,510,665 B2 1/2003 Pervan
6,516,579 B1 2/2003 Pervan
6,517,935 B1 2/2003 Kornfalt et al.
6,532,709 B2 3/2003 Pervan
6,536,178 B1 3/2003 Palsson
6,550,205 B2 4/2003 Neuhofer
6,588,165 B1 7/2003 Wright
6,588,166 B2 7/2003 Martensson et al.
6,591,568 B1 7/2003 Palsson
6,601,359 B2 8/2003 Olofsson
6,606,834 B2 8/2003 Martensson et al.
6,647,690 B1 11/2003 Martensson
6,672,030 B2 1/2004 Schulte
6,681,820 B2 1/2004 Olofsson
6,682,254 B1 1/2004 Olofsson
6,711,869 B2 3/2004 Tychsem
6,729,091 B1 5/2004 Martensson
6,745,534 B2 6/2004 Kornfalt
6,763,643 B1 7/2004 Martensson
6,769,219 B2 8/2004 Schwitte et al.
6,769,835 B2 8/2004 Stridsman
6,786,016 B1 9/2004 Wood
6,805,951 B2 10/2004 Kornfalt et al.
6,851,241 B2 2/2005 Pervan
6,854,235 B2 2/2005 Martensson
6,860,074 B2 3/2005 Stanchfield
6,880,305 B2 4/2005 Pervan et al.
6,880,307 B2 4/2005 Schwitte et al.
6,898,913 B2 5/2005 Pervan
6,920,732 B2 7/2005 Marensson
6,931,798 B1 8/2005 Pocai
6,966,161 B2 11/2005 Palsson et al.
RE38,950 E 1/2006 Maiers et al.
7,021,019 B2 4/2006 Knauseder
7,086,205 B2 8/2006 Pervan
7,121,058 B2 10/2006 Palsson et al.
7,121,059 B2 10/2006 Pervan
7,131,242 B2 11/2006 Martensson
7,152,507 B2 12/2006 Solari
7,210,272 B2 5/2007 Friday
7,332,053 B2 2/2008 Palsson et al.
7,347,328 B2 3/2008 Hartwall
7,398,628 B2 7/2008 Van Horne
7,441,385 B2 10/2008 Palsson et al.
7,451,578 B2 11/2008 Hannig
7,497,058 B2 * 3/2009 Martensson ..... 52/582.1
7,552,568 B2 6/2009 Palsson et al.

(56) References Cited

U.S. PATENT DOCUMENTS

| | | | | |
|---|---|---|---|---|
| 7,603,826 | B1 | 10/2009 | Moebus | |
| 7,634,884 | B2 | 12/2009 | Pervan et al. | |
| 7,726,088 | B2 | 6/2010 | Muehlebach | |
| 7,856,784 | B2 * | 12/2010 | Martensson | 52/582.1 |
| 7,877,956 | B2 * | 2/2011 | Martensson | 52/747.1 |
| 7,980,039 | B2 | 7/2011 | Groeke et al. | |
| 7,980,043 | B2 | 7/2011 | Moebus | |
| 8,028,486 | B2 | 10/2011 | Pervan et al. | |
| 8,037,657 | B2 | 10/2011 | Sjoberg et al. | |
| 8,038,363 | B2 | 10/2011 | Hannig et al. | |
| 8,117,795 | B2 | 2/2012 | Knauseder | |
| 8,146,318 | B2 | 4/2012 | Palsson | |
| 8,234,834 | B2 * | 8/2012 | Martensson et al. | 52/747.1 |
| 8,276,342 | B2 * | 10/2012 | Martensson | 52/582.1 |
| 8,402,709 | B2 | 3/2013 | Martensson | |
| 2001/0029720 | A1 | 10/2001 | Pervan | |
| 2002/0007608 | A1 | 1/2002 | Pervan | |
| 2002/0046526 | A1 | 4/2002 | Knauseder | |
| 2002/0046528 | A1 | 4/2002 | Pervan et al. | |
| 2002/0095895 | A1 | 7/2002 | Daly et al. | |
| 2002/0100242 | A1 | 8/2002 | Olofsson | |
| 2002/0112433 | A1 | 8/2002 | Pervan | |
| 2002/0127374 | A1 | 9/2002 | Spratling | |
| 2002/0148551 | A1 | 10/2002 | Knauseder | |
| 2002/0178673 | A1 | 12/2002 | Pervan | |
| 2002/0178674 | A1 | 12/2002 | Pervan | |
| 2002/0178681 | A1 | 12/2002 | Zancai et al. | |
| 2002/0178682 | A1 | 12/2002 | Pervan | |
| 2002/0189747 | A1 | 12/2002 | Steinwender | |
| 2003/0009972 | A1 | 1/2003 | Pervan et al. | |
| 2003/0024199 | A1 | 2/2003 | Pervan et al. | |
| 2003/0033784 | A1 | 2/2003 | Pervan | |
| 2003/0084634 | A1 | 5/2003 | Stanchfield | |
| 2003/0084636 | A1 | 5/2003 | Pervan | |
| 2003/0094230 | A1 | 5/2003 | Sjoberg | |
| 2003/0118812 | A1 | 6/2003 | Kornfalt | |
| 2003/0141004 | A1 | 7/2003 | Palmblad | |
| 2003/0145540 | A1 | 8/2003 | Brunedal | |
| 2003/0154678 | A1 | 8/2003 | Stanchfield | |
| 2003/0159389 | A1 | 8/2003 | Kornfalt | |
| 2003/0224147 | A1 | 12/2003 | Maine et al. | |
| 2004/0016197 | A1 | 1/2004 | Ruhdorfer | |
| 2004/0031225 | A1 | 2/2004 | Fowler | |
| 2004/0031226 | A1 | 2/2004 | Miller | |
| 2004/0031227 | A1 | 2/2004 | Knauseder | |
| 2004/0040235 | A1 | 3/2004 | Kurtz | |
| 2004/0041225 | A1 | 3/2004 | Nemoto | |
| 2004/0139678 | A1 | 7/2004 | Pervan | |
| 2004/0182036 | A1 | 9/2004 | Sjoberg et al. | |
| 2004/0191461 | A1 | 9/2004 | Riccobene | |
| 2004/0211143 | A1 | 10/2004 | Hanning | |
| 2005/0034405 | A1 | 2/2005 | Pervan | |
| 2005/0144881 | A1 | 7/2005 | Tate | |
| 2005/0166526 | A1 | 8/2005 | Stanchfield | |
| 2005/0210810 | A1 | 9/2005 | Pervan | |
| 2005/0252130 | A1 | 11/2005 | Martensson | |
| 2006/0101769 | A1 | 5/2006 | Pervan | |
| 2006/0236642 | A1 | 10/2006 | Pervan | |
| 2006/0248836 | A1 | 11/2006 | Martensson | |
| 2007/0006543 | A1 | 1/2007 | Engstrom | |
| 2007/0028547 | A1 | 2/2007 | Grafenauer et al. | |
| 2007/0240376 | A1 | 10/2007 | Engstrom | |
| 2008/0000186 | A1 | 1/2008 | Pervan | |
| 2008/0134613 | A1 | 6/2008 | Pervan | |
| 2008/0216434 | A1 | 9/2008 | Pervan | |
| 2008/0236088 | A1 | 10/2008 | Hannig | |
| 2008/0271403 | A1 | 11/2008 | Palsson | |
| 2009/0019806 | A1 | 1/2009 | Muehlebach | |
| 2009/0064624 | A1 | 3/2009 | Sokol | |
| 2009/0100782 | A1 | 4/2009 | Groeke et al. | |
| 2009/0193748 | A1 | 8/2009 | Boo et al. | |
| 2009/0199500 | A1 | 8/2009 | LeBlang | |
| 2009/0217615 | A1 | 9/2009 | Engstrom | |
| 2010/0031599 | A1 | 2/2010 | Kennedy et al. | |
| 2010/0043333 | A1 | 2/2010 | Hannig | |
| 2010/0058700 | A1 | 3/2010 | LeBlang | |
| 2011/0167751 | A1 | 7/2011 | Engstrom | |
| 2011/0173914 | A1 | 7/2011 | Engstrom | |
| 2011/0271631 | A1 | 11/2011 | Engstrom | |
| 2011/0271632 | A1 | 11/2011 | Cappelle et al. | |
| 2011/0293361 | A1 | 12/2011 | Olofsson | |
| 2012/0042595 | A1 | 2/2012 | De Boe | |
| 2012/0055112 | A1 | 3/2012 | Engstrom | |
| 2012/0233948 | A1 | 9/2012 | Palsson | |
| 2012/0247053 | A1 | 10/2012 | Martensson | |
| 2012/0291396 | A1 | 11/2012 | Martensson | |
| 2012/0304590 | A1 | 12/2012 | Engstrom | |
| 2013/0042555 | A1 | 2/2013 | Martensson | |
| 2013/0067840 | A1 | 3/2013 | Martensson | |

FOREIGN PATENT DOCUMENTS

| | | |
|---|---|---|
| BE | 417526 | 12/1936 |
| BE | 557844 | 3/1960 |
| BE | 1010339 | 6/1996 |
| BE | 1010487 | 10/1998 |
| CA | 991373 | 6/1976 |
| CA | 1169106 | 6/1984 |
| CA | 2226286 | 12/1997 |
| CA | 2252791 | 5/1999 |
| CA | 2289309 | 11/1999 |
| CH | 200949 | 1/1939 |
| CH | 211677 | 1/1941 |
| CH | 211877 | 1/1941 |
| CH | 562 377 | 5/1975 |
| DE | 209979 | 11/1906 |
| DE | 1212275 | 3/1966 |
| DE | 1985418 | 5/1968 |
| DE | 1534802 | 4/1970 |
| DE | 7102476 | 6/1971 |
| DE | 1534278 | 11/1971 |
| DE | 2101782 | 7/1972 |
| DE | 2145024 | 3/1973 |
| DE | 2159042 | 6/1973 |
| DE | 2238660 | 2/1974 |
| DE | 2251762 | 5/1974 |
| DE | 7402354 | 5/1974 |
| DE | 2502992 | 7/1976 |
| DE | 2616077 | 10/1977 |
| DE | 2917025 | 11/1980 |
| DE | 3104519 | 2/1981 |
| DE | 3041781 | 5/1982 |
| DE | 3214207 | 11/1982 |
| DE | 4134452 | 4/1983 |
| DE | 3246376 | 6/1984 |
| DE | 3304992 | 8/1984 |
| DE | 3306609 | 9/1984 |
| DE | 3319235 | 11/1984 |
| DE | 3343601 | 6/1985 |
| DE | 8604004 | 8/1986 |
| DE | 3512204 | 10/1986 |
| DE | 3544845 | 6/1987 |
| DE | 3631390 | 12/1987 |
| DE | 3640822 | 6/1988 |
| DE | 8600241 | 4/1989 |
| DE | 400254-70 | 8/1991 |
| DE | 3932980 | 11/1991 |
| DE | 9300306 | 3/1993 |
| DE | 4215273 | 11/1993 |
| DE | 424530 | 6/1994 |
| DE | 43 44 089 | 7/1994 |
| DE | 9317191 | 3/1995 |
| DE | 296 14 086 | 10/1996 |
| DE | 29703962 | 6/1997 |
| DE | 29710175 | 8/1997 |
| DE | 29711960 | 10/1997 |
| DE | 19651149 | 6/1998 |
| DE | 19709641 | 9/1998 |
| DE | 19821938 | 11/1999 |
| DE | 20001225 | 7/2000 |
| DE | 19925248 | 12/2000 |
| DE | 20018284 | 1/2001 |
| DE | 20017461 | 2/2001 |
| DE | 20027461 | 3/2001 |

(56) References Cited

FOREIGN PATENT DOCUMENTS

| | | |
|---|---|---|
| DE | 100 01 076 | 10/2001 |
| DE | 517353 | 5/2002 |
| DE | 10062873 | 7/2002 |
| DE | 10131248 | 1/2003 |
| DE | 10 2005 002 297.9 | 8/2005 |
| DE | 10 2007 035 648 | 1/2009 |
| DE | 2009 022 483.1 | 5/2009 |
| DE | 20 2009 004 530 | 6/2009 |
| DE | 10 2010 004717.1 | 1/2010 |
| DE | 10 2009 038 750 | 3/2011 |
| EP | 0085196 | 8/1983 |
| EP | 0248127 | 12/1987 |
| EP | 0220389 | 5/1992 |
| EP | 0623724 | 11/1994 |
| EP | 0652340 | 5/1995 |
| EP | 0698162 | 2/1996 |
| EP | 000711886 | 5/1996 |
| EP | 0843763 | 5/1998 |
| EP | 0849416 | 6/1998 |
| EP | 0855482 | 7/1998 |
| EP | 0877130 | 11/1998 |
| EP | 0903451 | 3/1999 |
| EP | 0958441 | 11/1999 |
| EP | 0969163 | 1/2000 |
| EP | 0969164 | 1/2000 |
| EP | 0974713 | 1/2000 |
| EP | 1229181 | 8/2002 |
| EP | 2400076 | 8/2004 |
| EP | 2 034 106 | 3/2009 |
| FI | 843060 | 8/1984 |
| FR | 557844 | 8/1923 |
| FR | 1175582 | 3/1959 |
| FR | 1215852 | 4/1960 |
| FR | 1293043 | 5/1962 |
| FR | 2568295 | 1/1986 |
| FR | 2630149 | 10/1989 |
| FR | 2637932 | 4/1990 |
| FR | 2675174 | 10/1992 |
| FR | 2691491 | 11/1993 |
| FR | 2891491 | 11/1993 |
| FR | 2691691 | 12/1993 |
| FR | 2697275 | 4/1994 |
| FR | 2712329 | 5/1995 |
| FR | 2781513 | 1/2000 |
| FR | 2785633 | 5/2000 |
| FR | 2810060 | 12/2001 |
| GB | 424057 | 2/1935 |
| GB | 599793 | 3/1946 |
| GB | 585205 | 1/1947 |
| GB | 636423 | 4/1950 |
| GB | 812671 | 4/1959 |
| GB | 812871 | 4/1959 |
| GB | 1212983 | 11/1970 |
| GB | 1237744 | 6/1971 |
| GB | 1348272 | 3/1974 |
| GB | 1430423 | 3/1976 |
| GB | 2117813 | 10/1983 |
| GB | 2126106 | 3/1984 |
| GB | 2142670 | 1/1985 |
| GB | 2168732 | 6/1986 |
| GB | 2228753 | 9/1990 |
| GB | 2243381 | 10/1991 |
| GB | 2256023 | 11/1992 |
| IT | 812671 | 4/1959 |
| JP | 5465528 | 5/1979 |
| JP | 57119056 | 7/1982 |
| JP | 64-14838 | 1/1989 |
| JP | 64-14839 | 1/1989 |
| JP | 1178659 | 7/1989 |
| JP | 02285145 | 11/1990 |
| JP | 3-18343 | 2/1991 |
| JP | 3-44645 | 4/1991 |
| JP | 3046645 | 4/1991 |
| JP | 3169967 | 7/1991 |
| JP | 4106264 | 4/1992 |
| JP | 4191001 | 7/1992 |
| JP | 5148984 | 6/1993 |
| JP | 6-146553 | 5/1994 |
| JP | 656310 | 8/1994 |
| JP | 6320510 | 11/1994 |
| JP | 752103 | 2/1995 |
| JP | 407052103 | 2/1995 |
| JP | 7076923 | 3/1995 |
| JP | 7180333 | 7/1995 |
| JP | 7229276 | 8/1995 |
| JP | 7279366 | 10/1995 |
| JP | 7300979 | 11/1995 |
| JP | 7310426 | 11/1995 |
| JP | 8086078 | 4/1996 |
| NL | 7601773 | 2/1957 |
| NO | 157871 | 7/1984 |
| NO | 305614 | 5/1995 |
| PL | 26931 | 6/1989 |
| SE | 372051 | 12/1974 |
| SE | 7114900-9 | 12/1974 |
| SE | 7706470 | 12/1978 |
| SE | 450141 | 6/1987 |
| SE | 8206934-5 | 6/1987 |
| SE | 457737 | 1/1989 |
| SE | 462809 | 4/1990 |
| SE | 467150 | 6/1992 |
| SE | 501014 | 10/1994 |
| SE | 9301595-6 | 2/1995 |
| SE | 502994 | 3/1996 |
| SE | 503861 | 9/1996 |
| SE | 509059 | 11/1998 |
| SE | 509060 | 11/1998 |
| SE | 512290 | 2/2000 |
| SE | 512313 | 2/2000 |
| SE | 513189 | 7/2000 |
| SE | 514645 | 3/2001 |
| SE | 0001149 | 10/2001 |
| SU | 363795 | 11/1973 |
| WO | WO80/02155 | 10/1980 |
| WO | WO 84/02155 | 6/1984 |
| WO | WO 8703839 | 7/1987 |
| WO | WO 9217657 | 10/1992 |
| WO | WO 93/13280 | 7/1993 |
| WO | WO 9401628 | 1/1994 |
| WO | WO 9426999 | 11/1994 |
| WO | WO 96/12857 | 5/1996 |
| WO | WO 96/23942 | 8/1996 |
| WO | WO 9623942 | 8/1996 |
| WO | WO 9627719 | 9/1996 |
| WO | WO 9627721 | 9/1996 |
| WO | WO 9630177 | 10/1996 |
| WO | WO 9747834 | 12/1997 |
| WO | WO 9822678 | 5/1998 |
| WO | WO 9824994 | 6/1998 |
| WO | WO 9824995 | 6/1998 |
| WO | WO 98/58142 | 12/1998 |
| WO | WO 9858142 | 12/1998 |
| WO | WO 9901628 | 1/1999 |
| WO | WO 9940273 | 8/1999 |
| WO | WO 9966151 | 12/1999 |
| WO | WO 9966152 | 12/1999 |
| WO | WO 0002214 | 1/2000 |
| WO | WO 0006854 | 2/2000 |
| WO | WO 00/20705 | 4/2000 |
| WO | WO 00/47841 | 8/2000 |
| WO | WO 0056802 | 9/2000 |
| WO | WO 0063510 | 10/2000 |
| WO | WO 0066856 | 11/2000 |
| WO | WO 01/02669 | 1/2001 |
| WO | WO 0120101 | 3/2001 |
| WO | WO 01/31141 | 5/2001 |
| WO | WO 01/51732 | 7/2001 |
| WO | WO 01/51733 | 7/2001 |
| WO | WO 01/75247 | 10/2001 |
| WO | WO 02/081843 | 10/2002 |
| WO | WO 03/083234 | 10/2003 |
| WO | WO 03093686 | 11/2003 |
| WO | WO 2005/040521 | 5/2005 |
| WO | WO 2005/054599 | 6/2005 |

(56) References Cited

FOREIGN PATENT DOCUMENTS

| | | |
|---|---|---|
| WO | WO 2005/059269 | 6/2005 |
| WO | WO 2006/043893 | 4/2006 |
| WO | WO 2007/008139 | 1/2007 |
| WO | WO 2007/089186 | 8/2007 |
| WO | WO 2007/141605 | 12/2007 |
| WO | WO 2008/004960 | 1/2008 |
| WO | WO 2008/068245 | 6/2008 |
| WO | WO 2009/066153 | 5/2009 |
| WO | WO 2009/139687 | 11/2009 |
| WO | WO 2010/082171 | 7/2010 |
| WO | WO 2010/136171 | 12/2010 |
| WO | WO 2011/085788 | 7/2011 |

OTHER PUBLICATIONS

Architectvral Graphic Standards; Jolm Wiley & Sons, Inc.
Bojlesystemet til Junckers boliggulve, Junckers Trae for Livet.
CLIC, Ali-Nr, 110 11 640.
Die mobile; Terbrack; 1968.
Elements of Rolling Practice; The United Steel Companies Limited Sheffield, England, 1963;pp. 116-117.
Encyclopedia of Wood Joints; A Fine Woodworking Book; pp. 1-151; 1992.
Fibolic Brochure, undated.
Fiboloc Literature, Mar. 1999.
Focus, Information Till Ana Medabetare, Jan. 2001, Kahrs pa Domotex I Hmmover, Tysklm1d, Jan. 13-16.
Fundamentals of Building Construction Materials and Methods; Copyright 1985; pp. 11.
High-Production Roll Forming; Society of Manufacturing Engineers Marketing Services Depmiment; pp. 189-.
Hot Rolling of Steel; Library of Congress Cataloging in Publication Data; Roberts, William L; p. 189.
Knight's American Mechanical Dictionary, vol. III. 1876, definition of scarf.
Knight's American Mechanical Dictionary; 3 Edwm•d H. Knight; vol. III; p. 2051; 1876.
Laminat-Boden, Clever-Clickq.
Letter to the USPTO dated May 14, 2002, regarding U.S. Appl. No. 90/005,744.
New Software Simplifies Snap-Fit Design; Design News; p. 148.
Opplaering OG Autorisasjon, Fibo-Trespo, ALLOC, Lmninatgulvet som Legges Uter Lin.
Patent Mit Inter-nationalem, Die Revolution ((von Grund auf)) Fibo-Trespo, Disstributed at the Domotex fair in.
Pergo, Clic Flooring, Laminatgolv.
Plastic Part Technology; 1991; pp. 161-162.
Plastic Product Design; Van Nostrand Reinhold Company; pp. 256-258.
Special Verdict, Civil Case No. 02.0736.
Technoscope; Modern Plastics, Aug. 1991; pp. 29-30.
The Clip System for Junckers Sports Floors, Junckers Solid Hardood Flooring, Almex 7, p. 1/2.
The Clip System for Junckers Sports Floors, Junckers Solid Hardood Flooring, Annex 8, p. 1/4.
Trabearbetning Anders Gronhmd, TralelmikCentrum.
Traditional Details; for Building Restoration, Renovation, and Rehabilitation: From the 1932-1951 Editions of.
Traindustrins Handbok "Snickeriarbete", Knut Larsson, Tekno's Handbocker Publikation 12-11 (1952).
Tree Pjecer; pp. 1-35.
U.S. Appl. No. 08/894,966, filed Aug. 1997, Pervan.
United States Court of Appeals for Federal Circuit; 2009-1107,-1122; Decided: Feb. 18, 2010.
United States Court of Appeals of the Federal Circuit; Case No. 02-CV-0736 and 03-CV-616; Mandate issued.
United States District Court Eastern District of Wisconsin; Judgment; Dated Oct. 10, 2008.
United States District Court Eastern District of Wisconsin; Order; Dated May 1, 2008.
United States District Court Eastern District of Wisconsin; Order; Dated Dec. 31, 2008.
United States District Court Eastern of Wisconsin; Pervan Testimony; Trial Day 5 (Official Transcript); pp.
United States District Court North Carolina; Pergo (Europe) *AB* v *Unilin Beheer BV*, Civil. Action No. 5:08-.
United States District Court of North Carolina; Pergo (Europe) *AB* v *Unilin Beheer BV*. Civil Action No. 5:08-.
U.S. Appl. No. 90/637,036, filed Oct. 2000, Pervan.
Webster's, Dictionary, p. 862, definition of scarf.
Whittington's Dictionary of Plastics; Edited by James F. Carley, Ph.D., PE; pp. 443, 461; 1993.
Wood Handbook; Forest Products Laboratory, 1999; "Glossary pp. G-1 to 0-14", Chapter 10, pp. 10-1 to 10-.
Non-Final Office Action for U.S. Appl. No. 13/492,512 dated Nov. 21, 2012.
Non-Final Office Action for U.S. Appl. No. 13/675,936 dated Dec. 31, 2012.
Search Report dated Apr. 21, 2001.
Non-Final Office Action for U.S. Appl. No. 10/270,163 dated Dec. 10, 2004.
Final Office Action for U.S. Appl. No. 10/270,163 dated Jun. 2, 2005.
Non-Final Office Action for U.S. Appl. No. 10/270,163 dated Dec. 14, 2005.
Final Office Action for U.S. Appl. No. 10/270,163 dated May 25, 2006.
Non-Final Office Action for U.S. Appl. No. 11/185,724 dated Sep. 26, 2006.
Non-Final Office Action for U.S. Appl. No. 11/483,636 dated Oct. 11, 2006.
Reexamination No. 90/007,366 dated Oct. 24, 2006.
Reexamination No. 90/007,526 dated Dec. 5, 2006.
Non-Final Office Action for U.S. Appl. No. 11/185,724 dated Apr. 19, 2007.
Non-Final Office Action for U.S. Appl. No. 11/483,636 dated Apr. 19, 2007.
Non-Final Office Action for U.S. Appl. No. 11/015,741 dated Sep. 6, 2007.
Non-Final Office Action for U.S. Appl. No. 11/242,127 dated Nov. 1, 2007.
Non-Final Office Action for U.S. Appl. No. 11/185,724 dated Jan. 9, 2008.
Final Office Action for U.S. Appl. No. 11/015,741 dated Feb. 26, 2008.
Non-Final Office Action for U.S. Appl. No. 11/483,636 dated Apr. 3, 2008.
Non-Final Office Action for U.S. Appl. No. 11/242,127 dated Apr. 29, 2008.
Examiner Interview Summary for U.S. Appl. No. 11/015,741 dated May 7, 2008.
Final Office Action for U.S. Appl. No. 11/185,724 dated Jul. 9, 2008.
Non-Final Office Action for U.S. Appl. No. 10/580,191 dated Jul. 16, 2008.
Reexamination No. 90/007,365 dated Aug. 5, 2008.
United States District Court Eastern District of Wisconsin; Order; Dated Oct. 10, 2008.
Final Office Action for U.S. Appl. No. 11/483,636 dated Nov. 20, 2008.
Non-Final Office Action for U.S. Appl. No. 11/242,127 dated Mar. 31, 2009.
Non-Final Office Action for U.S. Appl. No. 12/010,587 dated Jun. 23, 2009.
Non-Final Office Action for U.S. Appl. No. 11/483,636 dated Jul. 21, 2009.
Examiner Interview Summary for U.S. Appl. No. 11/185,724 dated Aug. 13, 2009.
Non-Final Office Action for U.S. Appl. No. 12/278,274 dated Sep. 24, 2009.
Final Office Action for U.S. Appl. No. 11/242,127 dated Nov. 24, 2009.
Non-Final Office Action for U.S. Appl. No. 10/580,191 dated Mar. 10, 2010.

(56) References Cited

OTHER PUBLICATIONS

Non-Final Office Action for U.S. Appl. No. 11/483,636 dated Mar. 17, 2010.
Final Office Action for U.S. Appl. No. 12/278,274 dated May 17, 2010.
Final Office Action for U.S. Appl. No. 12/010,587 dated May 25, 2010.
Final Office Action for U.S. Appl. No. 10/580,191 dated Oct. 6, 2010.
Non-Final Office Action for U.S. Appl. No. 12/278,274 dated Nov. 2, 2010.
Non-Final Office Action for U.S. Appl. No. 11/483,636 dated Dec. 7, 2010.
Non-Final Office Action for U.S. Appl. No. 12/010,587 dated Mar. 16, 2011.
Final Office Action for U.S. Appl. No. 12/278,274 dated Apr. 14, 2011.
Final Office Action for U.S. Appl. No. 11/483,636 dated May 24, 2011.
Non-Final Office Action for U.S. Appl. No. 13/048,646 dated May 25, 2011.
Non-Final Office Action for U.S. Appl. No. 12/966,861 dated Jul. 20, 2011.
Non-Final Office Action for U.S. Appl. No. 12/979,086 dated Aug. 3, 2011.
Non-Final Office Action for U.S. Appl. No. 12/010,587 dated Aug. 30, 2011.
Non-Final Office Action for U.S. Appl. No. 11/483,636 dated Sep. 28, 2011.
Decision revoking the European Patent EP-B-1 276 941 dated Oct. 21, 2011.
Final Office Action for U.S. Appl. No. 13/048,646 dated Nov. 1, 2011.
Final Office Action for U.S. Appl. No. 12/966,861 dated Jan. 20, 2012.
Final Office Action for U.S. Appl. No. 12/979,086 dated Jan. 25, 2012.
Final Office Action for U.S. Appl. No. 11/483,636 dated Feb. 7, 2012.
Non-Final Office Action for U.S. Appl. No. 12/966,797 dated Feb. 29, 2012.
Final Office Action for U.S. Appl. No. 13/204,481 dated Mar. 12, 2012.
Notice of Allowance for U.S. Appl. No. 12/966,861 dated Apr. 11, 2012.
Non-Final Office Action for U.S. Appl. No. 13/437,597 dated Jul. 9, 2012.
Notice of Allowance for U.S. Appl. No. 12/979,086 dated Jul. 19, 2012.
Non-final Office Action for U.S. Appl. No. 12/747,454 dated Aug. 6, 2012.
Final Office Action for U.S. Appl. No. 12/966,797 dated Aug. 8, 2012.
Non-Final Office Action for U.S. Appl. No. 13/452,183 dated Aug. 8, 2012.
Non-Final Office Action for U.S. Appl. No. 13/204,481 dated Sep. 7, 2012.
Non-Final Office Action for U.S. Appl. No. 13/567,933 dated Sep. 12, 2012.
Non-Final Office Action for U.S. Appl. No. 11/483,636 dated Oct. 10, 2012.
Advisory Action for U.S. Appl. No. 12/966,797 dated Oct. 18, 2012.
European Office Action dated Oct. 19, 2012.
Notice of Allowance for U.S. Appl. No. 13/437,597 dated Oct. 26, 2012.
Non-Final Office Action for U.S. Appl. No. 13/086,931 dated Nov. 7, 2012.
Notice of Allowance for U.S. Appl. No. 11/483,636 dated Nov. 23, 2012.
Notice of Allowance for U.S. Appl. No. 10/270,163 dated Dec. 13, 2012.
Non-Final Office Action for U.S. Appl. No. 12/966,797 dated Dec. 13, 2012.
Non-Final Office Action for U.S. Appl. No. 13/559,230 dated Dec. 20, 2012.
Notice of Allowability for U.S. Appl. No. 11/483,636 dated Jan. 3, 2013.
Notice of Allowance for U.S. Appl. No. 12/747,454 dated Jan. 8, 2013.
Notice of Allowance for U.S. Appl. No. 13/437,597 dated Jan. 9, 2013.
Final Office Action for U.S. Appl. No. 12/010,587 dated Jan. 28, 2013.
Non-Final Office Action for U.S. Appl. No. 13/620,098 dated Feb. 8, 2013.
Final Office Action for U.S. Appl. No. 13/204,481 dated Feb. 25, 2013.
Non-Final Office Action for U.S. Appl. No. 13/492,512 dated Feb. 26, 2013.
Non-Final Office Action for U.S. Appl. No. 11/015,741 dated Mar. 13, 2013.
Final Office Action for U.S. Appl. No. 13/567,933 dated Mar. 15, 2013.
Notice of Allowance for U.S. Appl. No. 11/242,127 dated Apr. 26, 2013.
Notice of Allowance for U.S. Appl. No. 13/437,597 dated Apr. 29, 2013.
Non-Final Office Action for U.S. Appl. No. 12/747,454 dated May 10, 2013.
Notice of Allowance for U.S. Appl. No. 11/185,724 dated May 20, 2013.
Non-Final Office Action for U.S. Appl. No. 13/559,242 dated Jun. 7, 2013.
Applicant-Iniated Interview Summary for U.S. Appl. No. 13/204,481 dated Jul. 29, 2013.
Corrected Notice of Allowability for U.S. Appl. No. 11/185,724 dated Aug. 1, 2013.
Final Office Action for U.S. Appl. No. 13/086,931 dated Aug. 5, 2013.
Notice of Allowance for U.S. Appl. No. 12/966,797 dated Aug. 7, 2013.
Notice of Allowance for U.S. Appl. No. 12/010,587 dated Aug. 14, 2013.
Notice of Allowance for U.S. Appl. No. 13/559,230 dated Aug. 20, 2013.

* cited by examiner

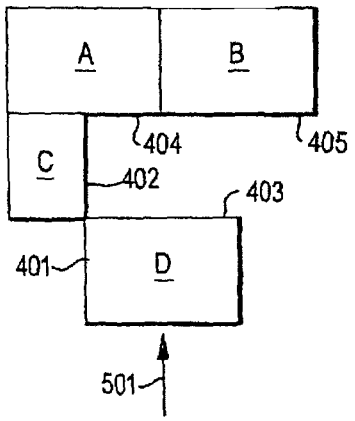
FIG. 13
FIG. 14
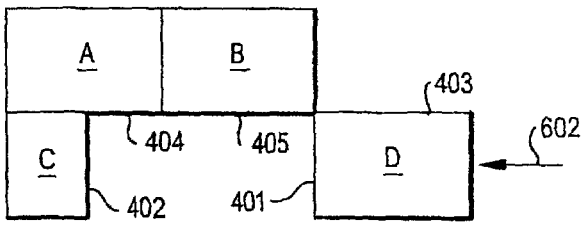
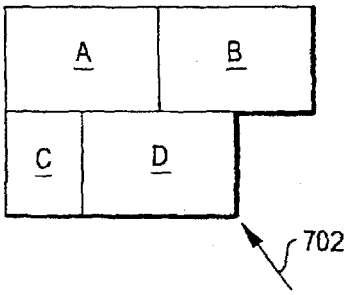
FIG. 15
FIG. 16
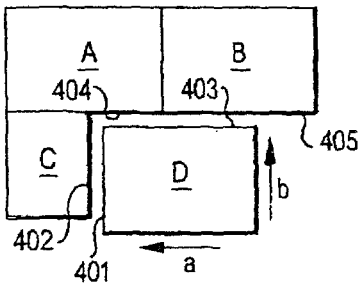

FLOORING PANEL OR WALL PANEL AND USE THEREOF

CROSS REFERENCE TO RELATED APPLICATIONS

This application is a continuation of and claims priority to U.S. application Ser. No. 11/483,636, filed Jul. 11, 2006, which is a division of U.S. application Ser. No. 10/642,139, filed Aug. 18, 2003, which is a division of U.S. application Ser. No. 10/195,408 (now U.S. Pat. No. 6,606,384), which is a continuation of U.S. application Ser. No. 09/705,916, filed Nov. 6, 2000 (now U.S. Pat. No. 6,421,970) which, in-turn, is a continuation-in-part of U.S. application Ser. No. 09/637,114, filed Aug. 11, 2000 (now U.S. Pat. No. 6,418,683), which, in turn, is a continuation-in-part of U.S. application Ser. No. 08/894,966, filed Sep. 28, 1997 (now U.S. Pat. No. 6,101,778), which, in turn, is a 35 USC §371 of PCT/SE96/00256, filed Feb. 29, 1996, the entire disclosures of which are herein incorporated by reference.

BACKGROUND OF THE INVENTION

1. Field of the Invention

The present invention relates to a building panel, such as a flooring panel or wall panel and the use thereof to form floors, walls, cladding, etc., by assembling a plurality of the panels. In one embodiment, the panels have particular utility for flooring or cladding a wet room.

2. Description of the Related Art

During the last few years laminated floors have achieved and increased in popularity and on many markets they are beginning to replace parquet floors and wall-to-wall carpets. In the production of laminated floors a decorative thermosetting laminate is first produced. This laminate usually consists of a base layer of paper sheets impregnated with phenol-formaldehyde resin and a decorative surface layer comprising a decor paper sheet impregnated with melamine-formaldehyde resin. The laminate is produced by pressing the different layers at a high pressure arid at an increased temperature.

The laminate thus obtained is then glued to a carrier of particle board, for instance, or used as such without any carrier and it is then called compact laminate. The laminated panel thus produced is then sawn up to a number of floor boards which are provided with groove and tongue at the long sides and the short sides thereof. Often the floor boards produced have a thickness of about 7 mm, a length of 120 cm and a width of about 20 cm. Thereby they can usually be put on top of an existing flooring material at a renovation. According to another alternative, instead one or more of the above decorative sheets can be laminated directly towards a base sheet of particle board for instance:

At the assemblage of such a flooring, glue is normally applied in the groove when the floor boards are assembled. Therefore, it will be difficult to change a damaged board or to remove a whole flooring and, for instance, install it in another room.

To avoid the above problem efforts have been made to achieve floor boards which can be assembled without glue. One such construction is disclosed in the U.S. Pat. No. 5,295,341. There the boards are provided with groove and tongue in the usual way, but here a snap-together system is included in the groove-tongue joint.

These floor boards can be assembled without glue. However, they have the disadvantage that the joints between the boards will be flexible and not rigid. Moreover, the joint between adjacent boards is not tight. This means that if the surface below the floor boards is not completely even, which is usually the case, a gap will be formed between the boards. Into these gaps dirt and water can penetrate.

SUMMARY OF THE INVENTION

According to the present invention, the last mentioned problem has been solved and a building panel, such as a flooring panel or wall panel, preferably of thermosetting laminate having two pairs of parallel side edges has been brought about. Two of these side edges are provided with a locking means in the form of a groove and the other two are provided with a tongue fitting in the groove whereby a tongue/groove joint for assembling of the panels is formed. The groove and the tongue are made of a water resistant or water tight material and formed with a snap-together joint including one or more snapping webs or the like with corresponding cooperating snapping grooves. In one embodiment, the groove in front of the snap-together joint has an entrance opening and continues inside the snap-together joint into a stabilizing groove. The tongue is formed with a rear neck intended to fit in the entrance opening and a forwardly protruding stabilizing part situated in front of the snap-together joint and intended for a tight fit in the stabilizing groove, whereby connecting panels when assembled by the snap-together joints and the stabilizing parts in the stabilizing grooves are fixed to each other and prevented from unintentional separation while at the same time a rigid floor covering or wall covering respectively with water tight joints and without unintentional gaps between the panels is obtained. In other embodiments, where the effect provided by the stabilizing groove and stabilizing part is not desired, these stabilizing parts can be omitted.

According to one preferred embodiment two adjacent side edges of the panel are provided with a groove and the other two side edges with a tongue. In this embodiment, the panel is usually quadrilateral, such as rectangular, but it can also be square.

In square panels it is also possible to provide a pair of parallel sides with a groove and the other pair with a tongue. However, the choice of pattern on the surface layer of the panel is limited with this shape. In other embodiments, the perimeter of the panel comprises three or five, or more, such as six or eight, side edges and the arrangement of the grooves and tongues can be varied. The series of panels which are connected to form a floor, wall, or other system need not all be of the same shape.

It is preferred that the groove and the tongue are made of a water proof or water resistant material, such as a thermoplastic, a thermosetting laminate, aluminum or a cellulosic product such as a wood fiber board, chipboard or particle board or a veneer impregnated or coated with a waterproofing material, such as oil, wax or a thermoplastic or thermosetting substance including, but not limited to, polymeric resins. It has been found that treating the panel with a liquid plastic substance such as a polyurethane gives excellent results. Of course, also other waterproof, water tight or water resistant materials can be used.

In another embodiment, the groove, as well as the tongue, are formed as a ledge fixed to the side edges of the panel. Suitably the ledge-formed groove and tongue respectively are then fixed in a recess along the side edges with glue, for instance. Alternatively, the integral tongue and groove portions of the panels can be formed in either the base material, the laminate material and/or both.

Protrusions which form the snapping webs can be formed on the upper and/or lower side of the tongue while cooperating depressions which form the snapping grooves are formed in the groove.

In one preferred embodiment one snapping web is formed on the upper side of the tongue and one on the lower side thereof while the groove has two fitting snapping grooves one at the top and one at the bottom of the groove. These snapping webs may be diametrically opposite one another or offset from one another. The corresponding snapping grooves will be positioned according to the position of the snapping webs so as to cooperate therewith. In an alternative, but equally preferred embodiment, the tongue may be provided with an uneven number of snapping webs on the upper and lower side of the tongues, e.g., none above and one below, one above and two below, etc.

If necessary one pair of snapping webs can be formed on the upper side of the tongue and one pair on the lower side thereof. Of course, you then need two snapping grooves at the top and two snapping grooves at the bottom of the groove to fit with the snapping webs. This construction will give an extremely strong joint.

Of course, in all these embodiments, the snapping webs can be arranged in the groove and the snapping grooves on the tongue. A greater number of snapping webs may also be positioned above the tongue than below the tongue without departing from the invention.

In the preferred embodiment using the stabilizing parts, the width of the stabilizing part is 1-10 mm, preferably 2-10 mm, most preferably 4-10 mm. Generally, a wider stabilizing part with fitting stabilizing groove gives a better rigidity of the assembled panels.

The stabilizing part will also assist in a correct assemblage of the panels. Thus, when the stabilizing part moves into the stabilizing groove you get a correct level of the panels and the panels can easily be pushed into the correct position where you do not have any gap between the panels. Of course, without any substantial gap between the panels, water and dirt are prevented from entering the assembled panels, flooring or wall covering.

As a safeguard against water penetration a seal might be arranged in the inner part of the stabilizing groove for instance. Alternatively, by selectively engineering the materials used in the tongue and/or groove portions of the panel of water resistant or water proof materials of suitable geometry and elastic modulus, the snapping action can be facilitated by permitting displacement or flexing of the elements defining the tongue and/or groove while the resilience permits snapping of the rocking feature to bring said panels into forming a tight joint such that the joint is said to be waterproof or water tight. A joint is water tight when standing water will not penetrate the joint for several hours.

Notwithstanding that the joint is tight to the point of being waterproof or water tight, the panels may be dismountable from each other after snapping the panels together.

Preferably the grooves and the tongues run the full length of the side edges of the panels, although they may be intermittently interrupted along the length of the panels.

The panels can be designed in such a manner that the underside of the groove and/or the tongue are situated in the same level as the underside of the panel.

The panels can be used for covering floors and walls in ordinary dry rooms. However, due to the tight joints and in other cases due to the rigid and water tightjoints, the panels can be used also for wet rooms. For such applications the whole panel is preferably made of plastic or thermosetting laminate of so-called compact laminate type. Such a laminate does not absorb water.

Another alternative is a water resistant and/or non water-absorbing base with a water tight surface. The surface may, for instance, consist of a paint, a thermoplastic foil such as polyethylene, polypropylene or polyvinyl chloride, a paper sheet impregnated with a resin, such as a thermosetting or UV-curing resin such as one comprising acrylate and a maleimide, or of a thermosetting laminate.

One suitable non water-absorbing base is a board produced by pressing and consolidating wood particles or wood chips impregnated with a thermoplastic.

The invention will be further explained in connection with the enclosed figures.

BRIEF DESCRIPTION OF THE DRAWINGS

FIGS. 13-16 disclose various methods of assembling the panels into a finished structure, such as a floor.

DETAILED DESCRIPTION OF THE PREFERRED EMBODIMENTS

The panel 1 consists of a base of cellulosic materials, such as wood particles impregnated with a resin, such as a thermoplastic material, with a decorative thermosetting laminate as a surface layer 17 glued on top.

Figure 1:
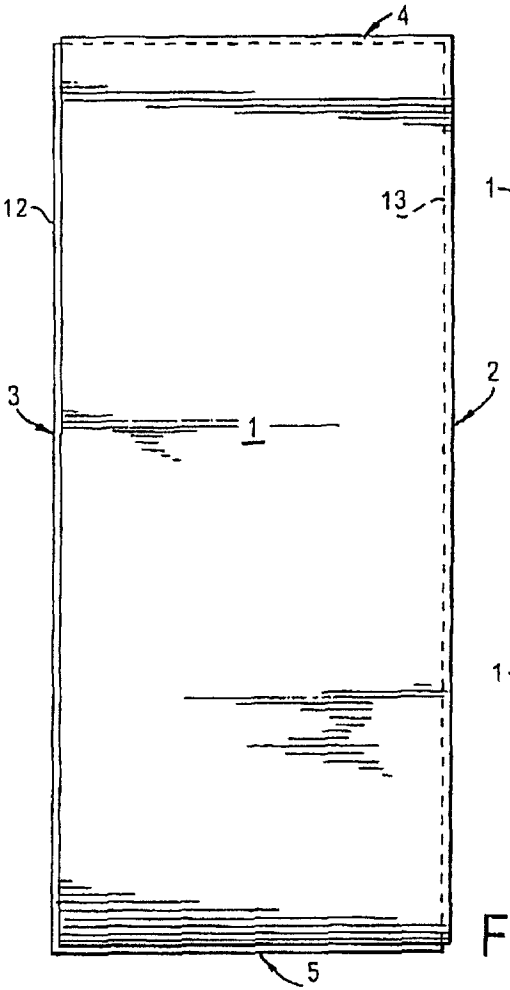
FIG. 1 schematically shows a panel 1 according to the invention seen from above. The panel is drawn as a rectangular shape but it can just as well be square or other quadrilateral.

The panel 1 has two pairs of parallel side edges 2, 3 and 4, 5 respectively (FIG. 1). Two of these side edges are provided with locking means in the form of a groove part 6 and the other two with a tongue 7 fitting in the groove part 6, whereby a tongue/groove joint for assembling of the panels is formed.

Figure 2:
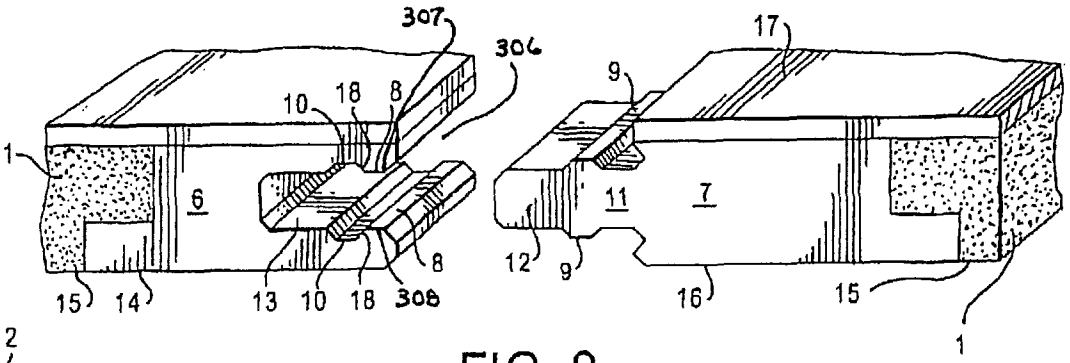
FIGS. 2 and 3 show across section through two adjacent edges of two embodiments of a panel where two such panels are to be assembled.
Figure 3:
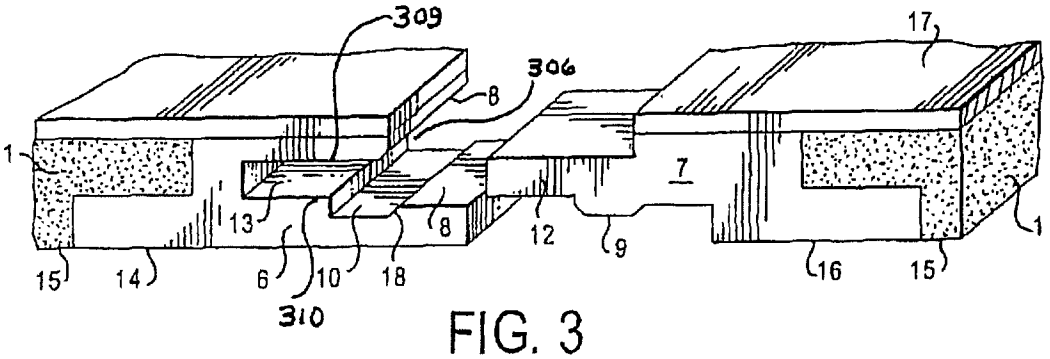

The groove 306 itself is a void, defined by at least an upper groove definition 307 and a lower groove definition 308 (FIG. 2), 309 and 310, respectively in FIG. 3. The groove part 6 and the tongue 7 are made of a water tight material and formed with a snap-together joint. In the embodiment shown in FIG. 2, the snap-together joint consists of two snapping webs 9, one on the upper side of the tongue 7 and one on the lower side of tongue, these webs 9 cooperating with two fitting snapping grooves 10.

In front of the snap-together joint, which means the snapping webs 9 and the snapping groove 10, the groove 306 has an entrance opening 8. Inside the snap-together joint the groove 106 continues in a stabilizing groove 13.

The tongue 7 is formed with a rear neck 11 intended to fit in the entrance opening 8 of the groove 306. In front of the snap-together joint the tongue 7 has a forwardly protruding stabilizing part 12 intended for a tight fit in the stabilizing groove 13.

The parts 9 and 10 included in the snap-together joint are also adapted to each other to give a tight fit and strong joint. To increase this effect further the snapping grooves 10 are provided with undercut edges 18 which cooperate with the backside of the snapping webs 9 with the same undercut.

In the embodiment of FIGS. 2 and 3, the groove part 6 and the tongue 7 are made of thermosetting laminate and formed as a ledge fixed by glue in a recess along the side edges of the panel. The under side 14 of the groove part 6 is situated in the same level as the under side 15 of the panel and the under side 16 of the tongue 7 is situated in the same level as the under side 15 of the panel 1. In the embodiments of FIGS. 4-12, the tongue and groove are formed of the same material as the body of the panel. Thus, when the body of the panel comprises a carrier of a resin impregnated cellulosic material, such as fiber board, the tongue and groove are formed of the same material as the carrier of the panel. In other embodiments, the base or carrier itself can be formed of a water repellent material, such as plastic. When pushed together, the panels make a distinctive sound, which we have nicknamed the "click" system.

When connecting panels have been assembled by the snap-together joints and the stabilizing parts 12 inserted in the stabilizing grooves 13, the panels are fixed to each other and prevented from unintentional separation. A rigid floor covering or wall covering with water tight joints and without unintentional gaps between the panels is obtained. The usual rotation of the snapping webs 9 in the snapping grooves 10 is prevented by the stabilizing parts 12 in the stabilizing grooves 13. Accordingly these parts are essential for the possibility to get a rigid joint between the panels.

The embodiment shown in FIG. 3 is very similar to that according to FIG. 2. The difference is that only the under side of the tongue 7 is provided with a snapping web 9. The upper side is lacking a snapping web. Accordingly there is only one snapping groove 10 at the bottom of the lower groove definition 308.

Figure 4:
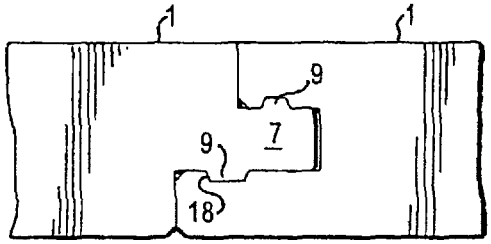
FIG. 4 is a schematic representation of a joint between two panels containing offset snapping webs on the tongue.

The embodiment of FIG. 4, though similar to FIG. 2 in having the upper and lower sides of tongue 7 provided with snapping webs 9, such snapping webs are longitudinal displaced along tongue 7.

Figure 5:
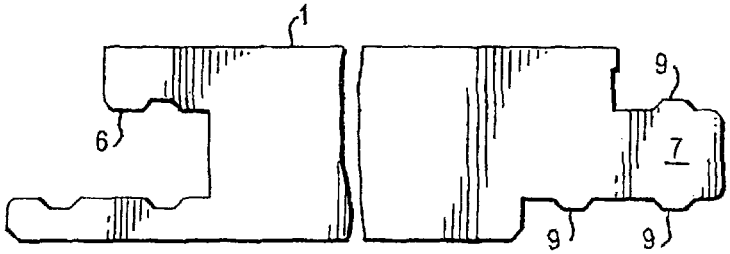
FIGS. 5-7 are schematic representations of three other embodiments showing different placements, number and arrangements of snapping webs and snapping grooves on panels.

The embodiment of FIG. 5 shows the provision of an uneven number of snapping webs 9 on tongue 7 where an upper and lower snapping web are vertically aligned but a third snapping web, positioned on the underside of the tongue 7 is longitudinally displaced at a distance towards the main body of the carrier.

Figure 6:
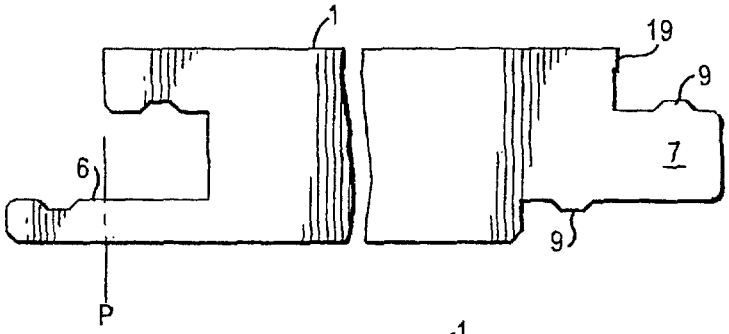

In FIG. 6 is illustrative of a further embodiment, similar to that of FIG. 4 in having longitudinally displaced upper and lower snapping webs 9. However, in FIG. 6 is provided a nose 19 on the upper edge of panel 1, proximate the tongue side of the panel. Such nose 19 assists in providing a tight joint when similar panels are assembled together. The nose may alternatively be provided on the groove side of the panel or further on both the tongue and groove sides of the panel.

Figure 7:
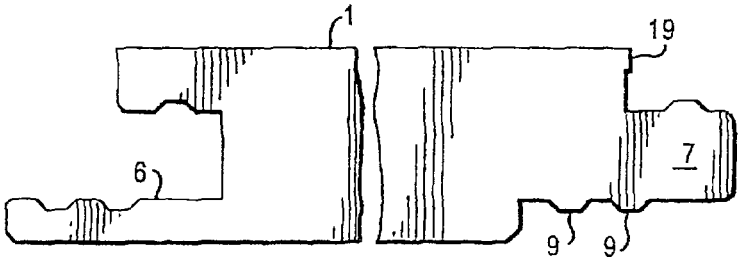

FIG. 7 illustrates the same type of nose 19 as in FIG. 6, however, in this embodiment, the lower snapping webs 9 are both longitudinally displaced towards the main body of panel 1 such that the most distal snapping web 9 lies vertically beneath nose 19 and the other snapping web 9 is inwardly positioned.

Figure 8:
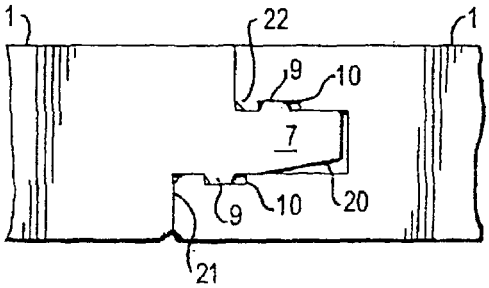
FIG. 8 is a schematic representation of a joint between two assembled panels in another embodiment of the invention.

The embodiment of FIG. 8 illustrates a unique design for both tongue 7 and snapping webs 9 and snapping grooves 10. In this embodiment, tongue 7 is undercut so as to provide a sloping surface 20. Moreover, the walls of the backsides of snapping webs 9 and the corresponding walls of snapping grooves 10 are vertical, or nearly so. This configuration permits at least one of the panels to be tilted relative to the other panel to provide for disassembly of the floor panels. The sloped surface 20 accommodates such tilting and thus, the disassembly of the panels. Moreover, the radius covers 21, 22 of the panels edges facilitate the "turning" of the assembled panels away from each other.

As in the embodiments of FIGS. 2 and 3, each of the embodiments of FIGS. 4-8 may comprise an upper surface of a thermosetting laminate, a plastic foil such as an olefin plastic, paper sheets impregnated with a thermosetting or UV-curing resin comprising acrylate and a maleimide or similar materials.

Figure 9:
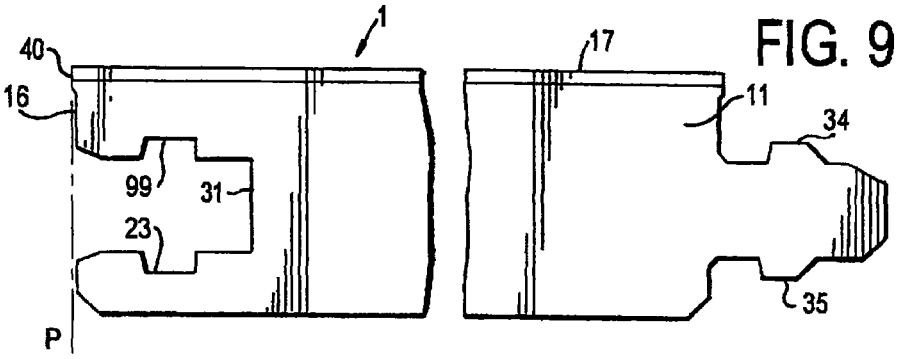
FIGS. 9-12 are schematic representations of four other alternative embodiments showing different placements, number and arrangements of snapping webs and snapping grooves on panels.

In FIGS. 9-12 a panel 1 comprises a base of cellulosic material 11 with a decorative surface 17. The decorative surface 17 can be a thermosetting laminate, a plastic foil, such as an olefin plastic, paper sheets impregnated with a thermosetting or UV-curing resin comprising acrylate and a maleimide or similar materials. The cellulosic material 11 is the same as or similar to that used in the embodiments of FIGS. 1-8. However, as shown in FIG. 9, groove part 16 contains an upper snapping groove 99 and a lower snapping groove 23. While each of groove 99 and 23 are vertically overlapping with each other, they are not coextensive. Snapping groove 99 is positioned proximate the groove edge 31 and snapping groove 23 extends further distal to groove edge 31, though both groove 99 and groove 23 are located with an imaginary vertical plane P extending through the top of panel edge 40. On the tongue side of panel 1 of FIG. 9 are two snapping webs 34, 35, configured and located so as to snap into cooperating grooves 99 and 23 on an identical panel (not shown).

Figure 10:
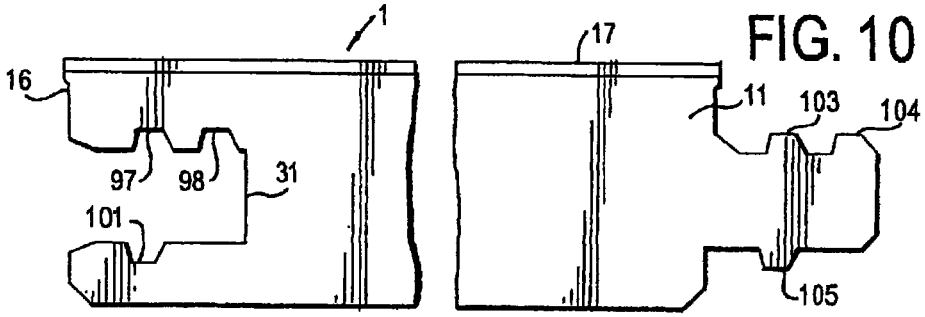

In FIG. 10, is a panel constructed similarly to that of FIG. 9, with the modification that two upper snapping grooves 97, 98 and one lower snapping groove 101 are provided. As can be seen in FIG. 10, the upper and lower snapping grooves engage with corresponding upper snapping webs 103, 104 and lower snapping web 105 when a similar panel 1 is located so as to check or snap into place.

Figure 11:
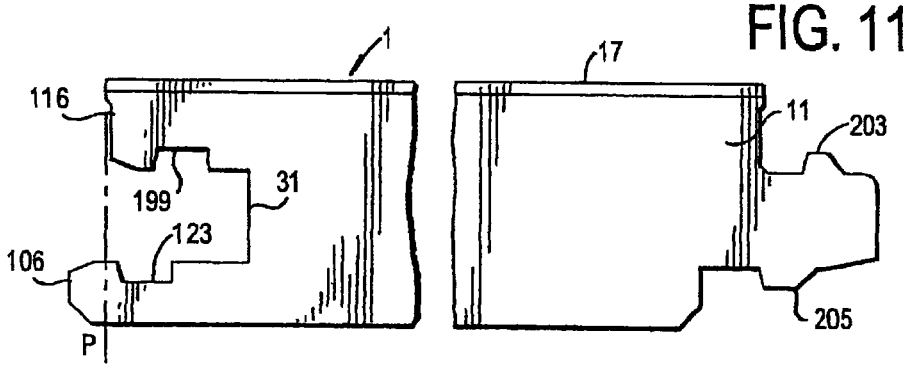

FIG. 11 is similar to FIG. 9 except that the position of upper and lower snapping grooves 199, 123, respectively, are offset as shown. Additionally, lower web 106 of groove edge 31 extends distally beyond plane P which is an imaginary vertical plane extending through the top web 116 of groove 31.

Snapping webs 203, 205 are configured so as to be received with corresponding snapping grooves 199, 123, respectively, when an identical panel is horizontally pushed into place.

Figure 12:
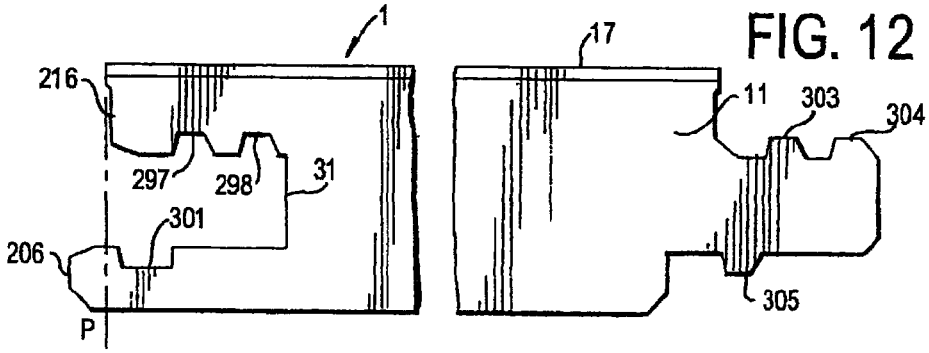

FIG. 12 is similar to FIG. 10 except insofar as the lower web 206 extends distally beyond imaginary plane P extending vertically from the top edge 216 of groove 31. As in the previous figures, upper and lower snapping webs 303, 304, 305 are configured so as to be matingly received in snapping grooves 297, 298 and 301 of an identical panel.

FIGS. 13-15 are illustrative of various ways to assemble the panels according to the invention. In each of these Figs. A and B represent two panels assembled in a first row, C represents a first panel assembled in a second row and D represents a new panel to be assembled so as to adjoin said first and second rows. All of such new panels D are assembled by horizontally pushing the new panel D in one of the following steps.

In FIG. 13, new panel D is engaged at its "short side" 401 with a short side 402 of panel C and is horizontally pushed in the direction of arrow 501 so as to slide along the short side 402 of panel C with panel D's respective upper and lower snapping webs are received in the respective upper and lower snapping grooves of panel C and until the "long sides" 403 of panel D engages with the edges 404, 405 of panels A and B.

In the alternative installation method of FIG. 14, new panel D is engaged at its long side 403 with the long side 405 of panel B and horizontally moved along arrow 602 until panel D's short side 401 engages with short side 402 of panel C. The horizontal motion does not require that any of the panels be "tilted" or "angled" out of the plane of the paper in order to joint the new panel D with any of the previously laid panels A-C.

Still further, new panel D may be simultaneously assembled with short side 402 of panel C and the long sides 404 and 405 of panels A and B by exerting a force in the direction of arrow 202 as shown in FIG. 15. A special tapping block (not shown) configured to engage with the tongue and groove segments of new panel D can be used to horizontal urge panel D into simultaneous engagement with each of panels A, B, and C.

FIG. 16 shows a "double" horizontal push method of assembling a new panel into engagement with previously laid panels. In this embodiment, new panel D is placed with its long side 403 at a distance (for instance, 2 cm) from the long sides 404 and 405 of panels A and B, respectively. Then the new panel D is pushed horizontally in the direction of arrow "a" until the short side of 401 of panel D snaps together with the short side 402 of panel C. Then, panel D is pushed horizontally in the direction of arrow "b" (while still engaged with panel C along the joint formed by short side 402 of panel C and short side 401 of panel D) until the side 403 of panel D snaps together with the long sides 404 and 405 of panels A and B, respectively.

Thus, we have disclosed not only a configuration of making panels having unique tongue and groove configurations which permit "glueless" assembly of the panels by a click. system, but also a method of assembling such panels into a finished structure, such as a floor.

The body of the panels in the embodiments are intended to be assembled without glue, but certainly glue or other sealing substance could be applied to the vicinity of the joint. Especially in the embodiments where the panels are intended to be installed in or proximate wet rooms, but also in ordinary rooms, the panels, especially the tongue and groove portions, can be coated or impregnated with a waterproofing material, such as an oil, wax, paint or other waterproofing material such as a liquid plastic coating, like polyurethane.

Alternatively, instead of a waterproof or water resistant layer on a carrier, the entire panel body can be made of a waterproof material, such as plastic, in which case the tongue and groove portions may be made of the same material as, and a unitary part of, the panel.

In still another embodiment of the invention, the joints can be "pre-glued," i.e., have a glue system applied at the factory which glue system can be activated upon assembly of the panels 1 into a finished structure, such as a floor. For example, the friction applied by assembling the panels as in FIGS. 13-16 can be used to rupture microballoons containing a catalyst or other component of an adhesive system to cause the assembled panels to be adhesively connected at the joint upon assembly.

Alternatively, the tongue portion of the panels can be pre-coated with one component of a two component adhesive system and the groove portion can be pre-coated with another component of the two component system, such that upon assembly of the tongue and groove portions of two adjacent panels, the adhesive system is activated to cause the panels to be adhesively connected at their joint.

It is within the scope of this adhesive system to include a blowing agent so as to form a foam filled adhesive. Alternatively, the adhesive may act more as a sealant, sealing the joint against ingress of water or other liquids when the panels are assembled into a structure, such as a floor.

Other adhesive systems, such as the use of initiators, inclusion of blowing or gas generating agents, multipart systems, such as a two resin system comprising pans one and two, wherein the catalyst or curing agent for part one is included with the part two resin and the catalyst or curing agent for part two is included with the part one resin may be applied at the factory, and initiated when the panels are installed.

Initiation may also occur when a protective strip is removed from the panel edges just prior to assembly of the panel, the removal of the protective strip exposing reactive components of the adhesive system.

Such modifications of the above pre-glued system will be apparent to those skilled in the art upon reading this disclosure.

It should be appreciated that we have provided a building panel and method of assembling the same which will result in tight joints between panels such that the assembled panels, used as flooring or cladding, which will be water repellent, that is, impervious to water standing on the surface of the joint, whether or not a pre-glued system is applied to the panel.

The invention is not limited to the embodiments shown and described sine these may be readily modified by those of ordinary skill in the art to which this invention pertains without departing from the scope of the appended claims.

The invention claimed is:

1. A floor panel for installation over a subfloor, comprising:

a core layer comprising a first thermoplastic material;

a surface layer disposed over the core layer, wherein the surface layer comprises a second thermoplastic material;

two pairs of opposing side edges defining first, second, third, and fourth side edges, wherein each of the side edges comprises coupling portions, wherein a first coupling portion of the first side edge comprises a groove and a second coupling portion of the second side edge comprises a tongue; wherein the tongue and the groove comprise a third thermoplastic material, wherein the tongue and groove are configured to join to an opposing groove and an opposing tongue, respectively, of adjacent panels, wherein the tongue and the groove are configured to lock with the opposing groove and opposing tongue, respectively, so as to prevent separation of the joined panels in a vertical as well as a horizontal direction;

wherein the groove comprises a lower lip portion that extends further in length than an upper portion of the groove;

wherein the surface layer is disposed over the core layer without extending over the tongue in a configuration prior to the tongue joining an adjacent panel; and wherein the panel is configured to be installed over a subfloor.

2. The floor panel according to claim 1, wherein the tongue and the groove are configured to click together.

3. The floor panel according to claim 1, wherein the tongue and the groove are configured to lock together as to prevent separation perpendicular to a plane of at least one edge of the panel.

4. The floor panel according to claim 1, wherein the thermoplastic material of the surface layer is polyvinyl chloride (PVC).

5. The floor panel according to claim 1, wherein a portion of the groove comprises at least one recess configured to engage a portion of the opposing tongue.

6. The floor panel according to claim 5, wherein the groove comprises a vertical plane corresponding to an outermost edge of the upper groove portion.

7. The floor panel according to claim 6, wherein the lower groove portion comprises at least one recess configured to engage a portion of the opposing tongue.

8. The floor panel according to claim 7, wherein at least a portion of the at least one recess extends beyond the vertical plane.

9. The floor panel according to claim 8, wherein the entire recess is positioned beyond the vertical plane.

10. The floor panel according to claim 1, wherein a portion of the tongue comprises at least one web configured to engage a portion of the opposing groove.

11. The floor panel according to claim 1, wherein the surface layer comprises a layer of plastic having a decorative design.

12. The floor panel according to claim 1, wherein two or all three of the thermoplastic materials are the same or different.

13. The floor panel according to claim 1, wherein the core layer constitutes a base material for the floor panel and wherein the tongue and groove are formed integrally with the base material, the first and third thermoplastic materials being the same thermoplastic material.

14. The floor panel according to claim 1, wherein both pairs of side edges comprise coupling portions configured to lock with an opposed edge to prevent separation of the joined panels in a vertical as well as a horizontal direction.

15. A floor panel for installation over a subfloor, the floor panel comprising:

a core layer comprising a third thermoplastic material;

a surface layer disposed over the core layer, wherein the surface layer comprises a second thermoplastic material; and two pairs of opposing side edges defining first, second, third, and fourth side edges, wherein each of the side edges comprises coupling portions, wherein a first coupling portion of the first side edge comprises a groove and a second coupling portion of the second side edge comprises a tongue; wherein the tongue and the groove comprise a third thermoplastic material, wherein the tongue and groove are configured to join with an opposing groove and an opposing tongue, respectively, of adjacent panels, wherein the tongue and the groove are configured to lock with the opposing groove and opposing tongue, respectively, so as to prevent separation of the joined panels in a vertical as well as a horizontal direction;

wherein the groove comprises a lower lip portion that extends further in length than an upper portion of the groove;

wherein the surface layer is configured to abut against a surface layer of a joined panel when the tongue and groove of adjacent panels cooperate; and wherein the panel is configured to be installed over a subfloor.

16. The floor panel according to claim 15, wherein two or all of the thermoplastic materials are the same or different.

17. The floor panel according to claim 15, wherein the core layer constitute a base material for the floor panel and wherein the tongue and groove are formed integrally with the base material, the first and third thermoplastic materials thereby being the same thermoplastic material.

18. The floor panel according to claim 15, wherein both pairs of opposing side edges comprise coupling portions configured to lock with an opposed edge to prevent separation of the joined panels in a vertical as well as a horizontal direction.

* * * * *